US006116003A

United States Patent [19]

Ziglin

[11] Patent Number: 6,116,003

[45] Date of Patent: Sep. 12, 2000

[54] WESTERN SADDLE TO ENGLISH GIRTH ADAPTOR

[75] Inventor: Stuart Ziglin, Chesterfield, Mo.

[73] Assignee: Ziglin and Smith Design, Inc., St Peters, Mo.

[21] Appl. No.: 09/041,302

[22] Filed: Mar. 12, 1998

[51] Int. Cl.[7] ..... B68C 1/00

[52] U.S. Cl. ..... 54/23; 54/46.1

[58] Field of Search ..... 54/23, 44.3, 4, 54/35, 46.1, 44.1, 44.7; 24/197

[56] References Cited

U.S. PATENT DOCUMENTS

| | | | |
|---|---|---|---|
| 481,180 | 8/1892 | Lane | 54/23 |
| 1,531,672 | 3/1925 | McLean | 54/46.1 |
| 1,610,989 | 12/1926 | Aguilar | 54/23 |
| 2,468,811 | 5/1949 | Carroll | 54/23 |
| 4,387,490 | 6/1983 | Blackburn et al. | 24/200 |

FOREIGN PATENT DOCUMENTS

| | | | |
|---|---|---|---|
| 4466 | 6/1901 | Austria | 54/44.1 |
| 151584 | 6/1904 | Germany | 54/44.1 |
| 20297 | 6/1901 | Sweden | 54/44.1 |
| 2173 | of 1881 | United Kingdom | 54/23 |
| 17766 | of 1898 | United Kingdom | 54/44.1 |

*Primary Examiner*—Robert P. Swiatek
*Assistant Examiner*—Son T. Nguyen
*Attorney, Agent, or Firm*—Mitchell Smith

[57] ABSTRACT

An adaptor which rigidly affixes a means for attaching the adaptor using the D-ring Western saddle attachment method to the multiple straps with adjustment hole attachment method of an English girth allowing for the use of this combination of dissimilar tack.

1 Claim, 3 Drawing Sheets

Plan View of Western Saddle to English Girth Adaptor

Side View of Western Saddle to English Girth Adaptor

Detail View of Western Saddle to English Girth Adaptor

WESTERN SADDLE TO ENGLISH GIRTH ADAPTOR

BACKGROUND OF THE INVENTION

Two types of saddles are available for use by the equestrian, an English and a Western saddle. Each of these saddles provides a different method of attachment and cinching of the girth, the strap which spans the underside of the horse attaching to both ends of the saddle. Each saddle type requires a different type girth. Currently, equestrians who wish to use both types of saddles require each of these two different types of girths. This invention allows the use of both saddles without the expense of owning both types of girths. The equestrian using this invention would only require the English girth to use both saddles types.

BRIEF SUMMARY OF THE INVENTION

The present invention provides an adaptor which will allow the equestrian to use both an English and a Western saddle without the cost of ownership of two different types of girths. Only an English girth is required as this invention allows the use of that girth on a Western saddle. Also it is thought throughout the industry that the English girth is superior to the Western girth because it is easier to cinch properly. A primary object of this invention is the combination of the strap method of attachment of an English girth and the D-ring attachment method of the Western girth allowing for the single girth to be used on both saddle types. Other objects and advantages will be readily apparent to those skilled in the art upon viewing the drawings and reading the detailed description hereafter.

DETAILED DESCRIPTION OF THE INVENTION

Figure 1:
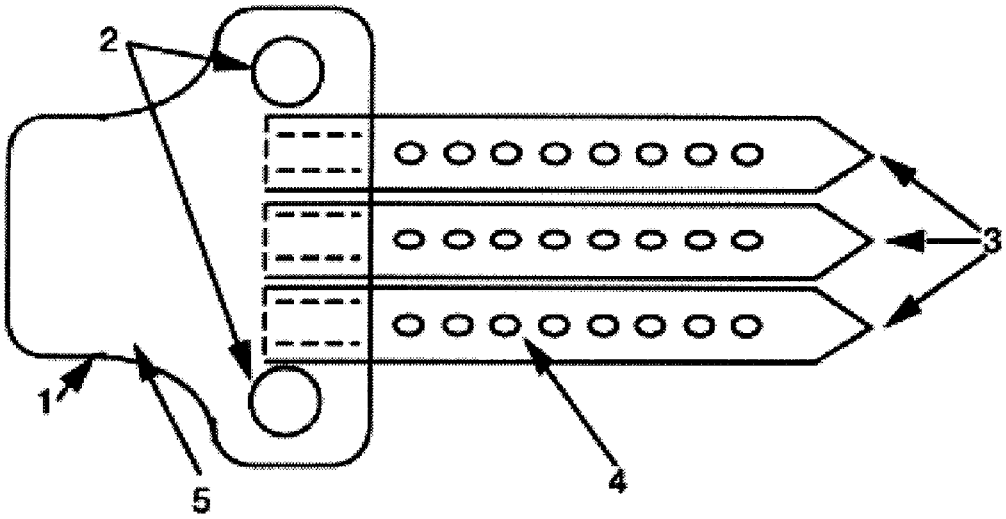
FIG. 1 is a plan view of the present invention.
Figure 2:
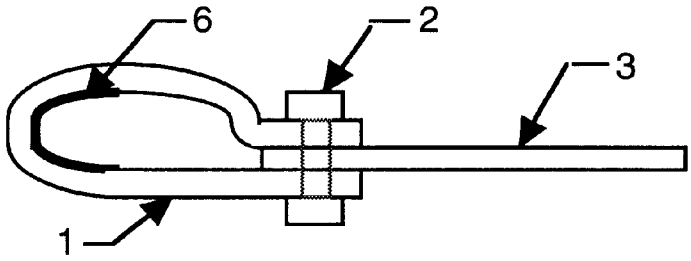
FIG. 2 is a side view of the present invention
Figure 3:
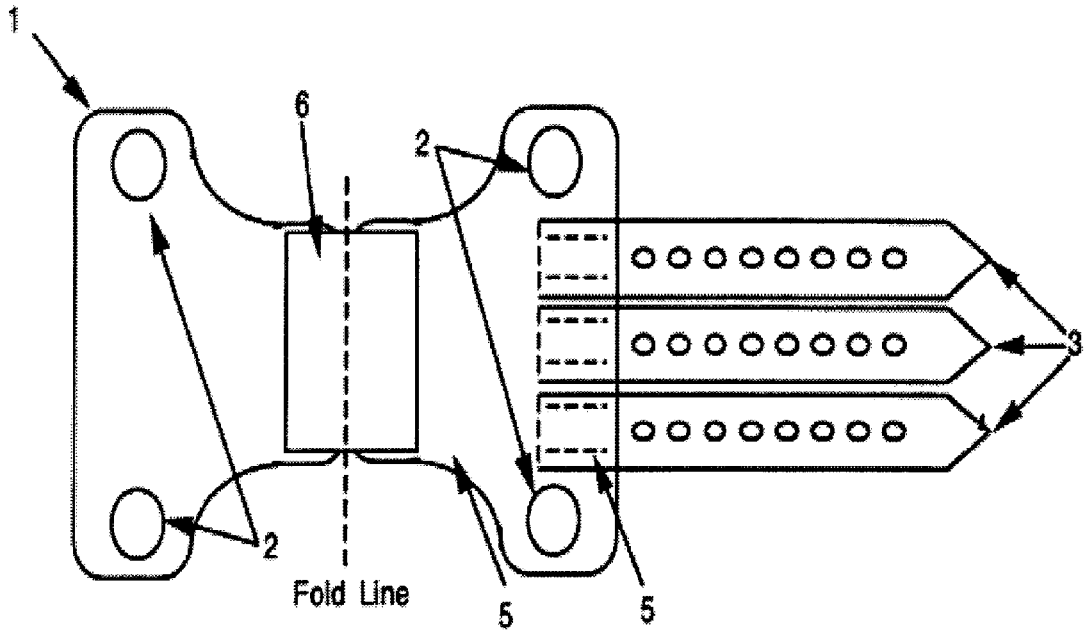
FIG. 3 is a detailed view of the Western saddle attachment section looking from above the present invention.

The embodiment of the present invention are illustrated in FIGS. 1, 2 and 3. Referring to FIG. 1 of the drawings, a Western saddle to English girth adaptor is shown according to the invention. Western saddle attachment 1 for accepting the D-ring attachment and English girth attachment 3 which requires a minimum of two straps with a multitude of holes 4 for adjustment with the buckle assembly on the English girth. The English girth attachment is fixed to the D-ring attachment either as a complete unit or as a separate assembly 5.

Referring to FIG. 2, a side view of the Western saddle to English girth adaptor shows the configuration of the Western saddle adaptor 1 showing the area where the Western saddle D-ring would rest. Also shown is the snap fastener 2 that firmly secures the Western saddle adaptor around the Western saddle D-ring. The English girth attachment 3 is also shown.

Further details of the Western saddle attachment can be seen in FIG. 3. Here the Western saddle attachment is unfolded to reveal the snap fastener 2 for securing the Western saddle attachment around the Western saddle D-ring. Also shown is a reinforcing pad 6 which provides additional support for the D-ring. Also shown is the attachment of the English girth attachment to the Western saddle assembly 5.

The above described embodiment is set forth by way of example and is not for the purpose of limiting the present invention. It will be readily apparent to those skilled in the art that obvious modifications, derivations and variations can be made to the embodiment without departing from the scope of the invention. Accordingly, the claims appended hereto should be read in their full scope including any such modifications, derivations and variations.

I claim:

1. A saddle to girth adaptor comprising a saddle attachment assembly, said saddle attachment assembly comprising a main body for the purpose of attachment to a saddle having a first free end, a second free end, and a means of fastening, said fastening means securely affixing the first free end to the second free end of the main body a girth attachment assembly consisting of multiple straps with multiple adjustment holes for attachment to a girth, said saddle attachment assembly rigidly affixed to said girth attachment assembly.

* * * * *